United States Patent [19]

Blue

[11] Patent Number: 5,072,947

[45] Date of Patent: Dec. 17, 1991

[54] RACQUET GAME WITH AIR BALL THEREOF

[76] Inventor: John D. Blue, 605 Hama Dr., Holiday, Fla. 34691

[21] Appl. No.: 617,138

[22] Filed: Nov. 23, 1990

[51] Int. Cl.[5] ..... F41J 5/04; A63B 37/06; A63B 61/00; A63B 63/08

[52] U.S. Cl. ..... 273/371; 273/29 B; 273/58 BA; 273/61 R; 273/65 R; 273/1.5 R; 273/402

[58] Field of Search ..... 273/5 A, 58 BA, 58 B, 273/58 D, 58 J, 58 E, 61 R, 65 R, 1.5 A, 26 A, 29 B, 29 A, 29 BB, 371, 374, 398, 402

[56] References Cited

U.S. PATENT DOCUMENTS

| | | | |
|---|---|---|---|
| 3,201,126 | 8/1965 | Nissen | 273/402 |
| 3,880,427 | 4/1975 | Bingham | 273/402 |
| 4,231,572 | 11/1980 | Thornton | 273/402 |
| 4,463,951 | 8/1984 | Kumasaka et al. | 273/58 BA |
| 4,643,433 | 2/1987 | Wehby | 273/402 |
| 4,762,319 | 8/1988 | Krumholz | 273/402 |
| 4,993,709 | 2/1991 | Tominaga | 273/26 A |

FOREIGN PATENT DOCUMENTS

| | | | |
|---|---|---|---|
| 428951 | 4/1911 | France | 273/58 R |

*Primary Examiner*—Benjamin Layno

[57] ABSTRACT

A competitive recreational game including: a foam game ball with symmetrical air holes throughout; a paddle or racquet; a target scoring net with holes or optional electronic sensor system attached to a frame with secured posts; a ball rebound catch set for each player; opposing basketball hoops with attached net to a backboard and a playing court with boundaries, scoring rules and regulations for all levels of play based on at least 1 opposing player. Points are scored in several strategic rewarding ways. The AIR BALL game is designed to be played on the beach, in the backyard or indoors on a floor surface. A one person practice board, designed to warmup touch and accuracy, is also part or an extention of this recreational game.

5 Claims, 5 Drawing Sheets

FIG. 2
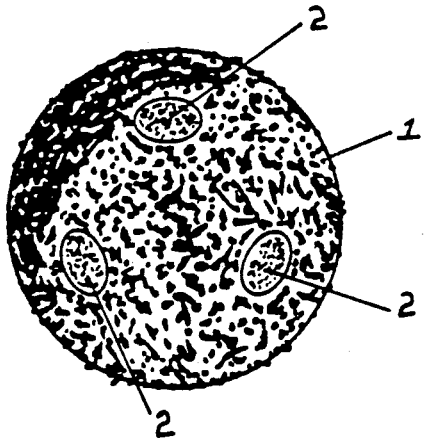
FIG. 3
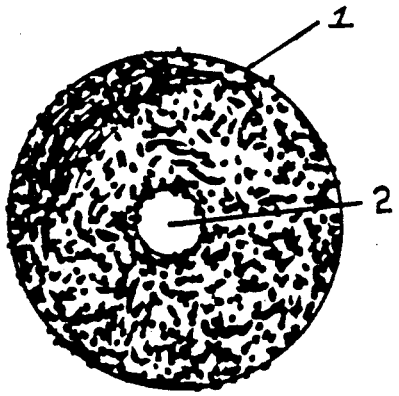
FIG. 4
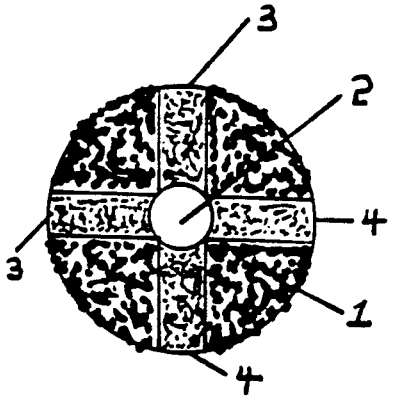
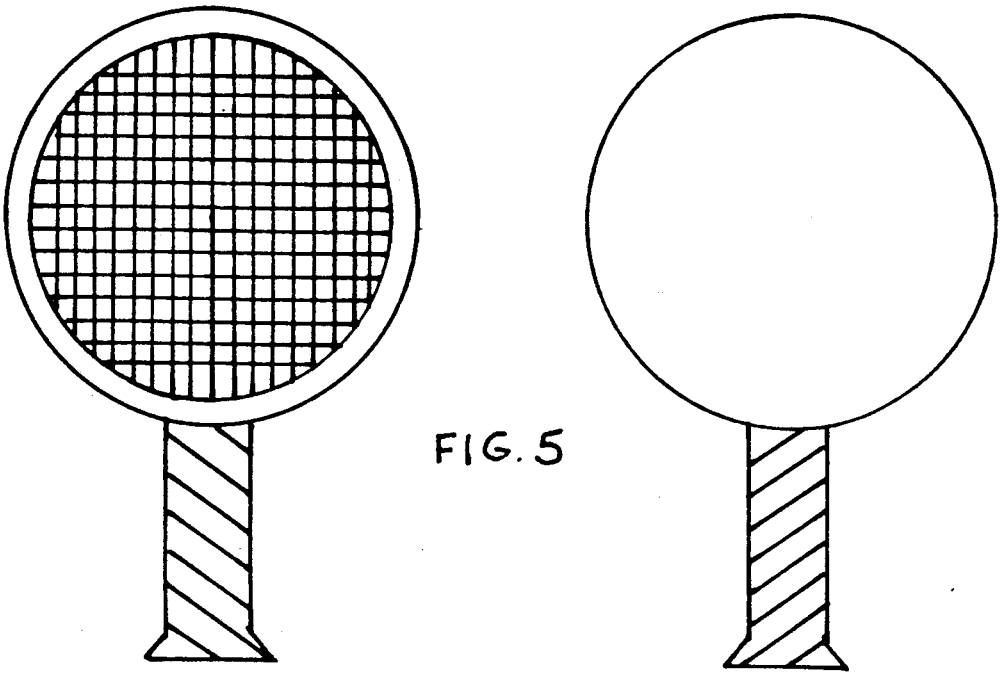
FIG. 5

FIG. 7
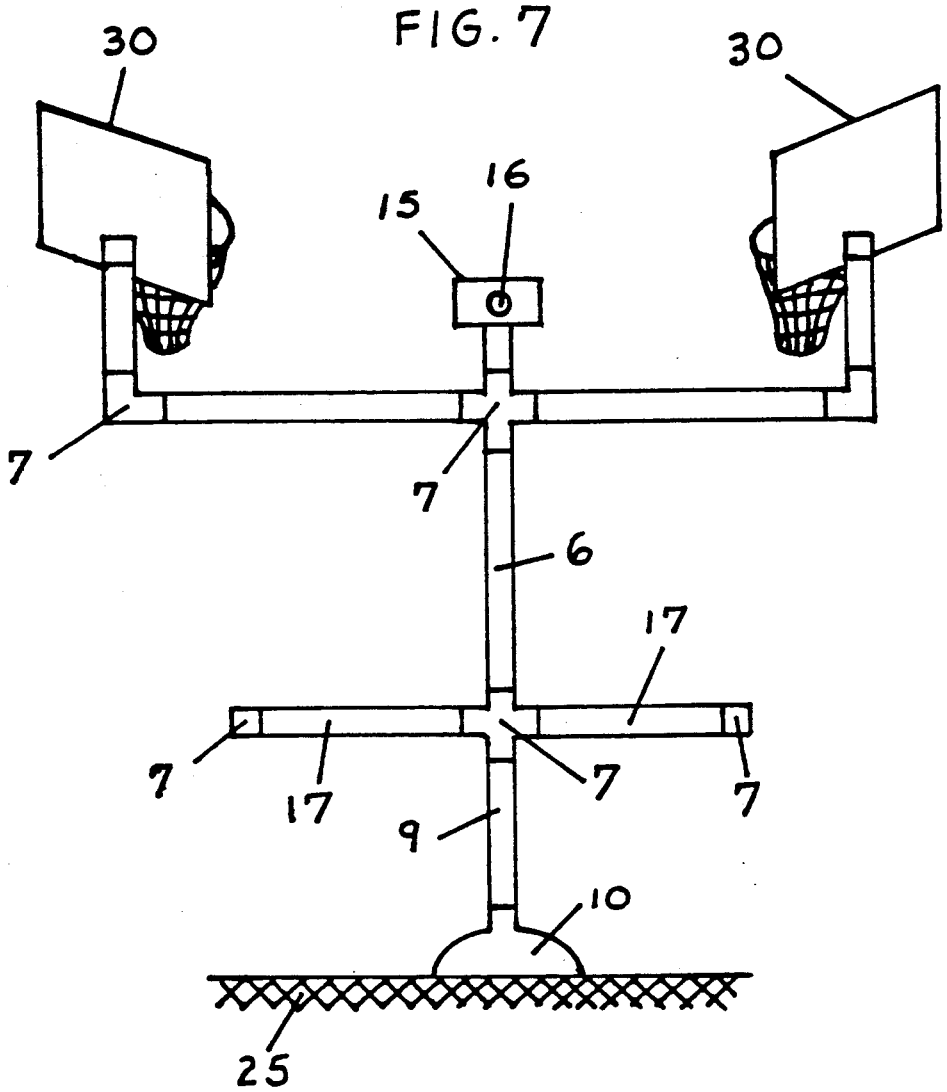
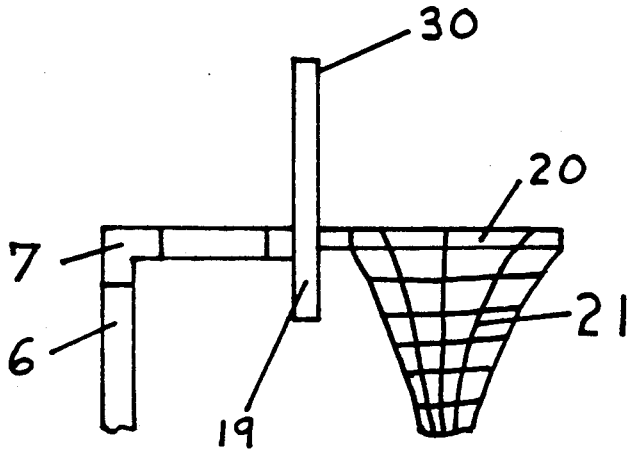
FIG. 8

RACQUET GAME WITH AIR BALL THEREOF

BACKGROUND OF THE INVENTION

1. Field of the Invention

This invention relates generally to a game apparatus with a foam air ball which is hit back and forth across a supported net on posts between at least 2 players on a defined playing court.

2. Prior Art Description

Competitive games of various types are numerous such as badminton, tennis and racquetball. These games range fron 1 player to 2 or more opposing players (single or doubles). An extensive search revealed numerous recreational competitive games such as in U.S. Pat. No. 3,968,968 (Peterson; in this game the players are on their knees playing minivolleyball with a net and supporting device; in U.S. Pat. No. 4,457,513 (Thompson) a defined playing area is indicated with 2 opposing players, a net apparatus and game ball; in U.S. Pat. No. 4,844,478 (Kessler) a very detailed racquet game with balloons, a net, posts, a special racquet and a carrier are presented; in U.S. Pat. No. 3,908,994 a badminton ball is disclosed with surface, only, holes in the shell but with a solid core; in U.S. Pat. No. 3,817,520 (Burgos) a game ball with players and a fixed court is revealed. The ball being solid with coils and strips; in U.S. Pat. No. 4,523,762 a playing field with supporting posts and a ball tether attached to the post apparatus is disclosed; in U.S. Pat. No. 4,415,154 a ball and target is revealed. The target apparatus being free-standing and the ball having surface or shell holes thereof; in U.S. Pat. No. 4,047,717 (DeAngeles) the volley game has a pair of portable basket members which are held by the opposing players and the game ball is attached by a cord to the configuration; in U.S. Pat. No. 4,807,879 a ball return/target sport is revealed with a free-standing target area of foam and a Wiffle or golf ball; in U.S. Pat. No. 4,874,169 (Litchfield) the game ball only has depressions or protrusions of the upper hemisphere; in U.S. Pat. No. 4,497,492 (Lehman, Jr. et al.) the game has a ball, a target area defended by the other player with a hand held shield and in U.S. Pat. No. 3,671,040 (Meyer et al.) the game has a rebound ball with a racquet like instrument.

After careful review of the aforementioned prior art it becomes evident that a variety of improvements are needed to overcome the game disadvantages which leave room for a novel Racquet and Air Ball game, in combination assembly.

SUMMARY OF THE INVENTION

The present invention relates to a recreational scoring game. The novel foam ball has holes punched or drilled throughtout the entire playing ball in a symmetrical manner which yields an AIR drag so as to limit the hitting distance. This ball becomes easier to control, see and play in a defined playing area. Two opposing players will hit the said ball across a court dividing net, which separates each players court playing area. The net is supported by an outlined frame such as P.V.C. pipe or by rope both of which are attached to and supported by posts at each end and said net has target scoring holes in the mesh of the vertical net. This said net also has an electronic target attached which is electrically wired to a score indicating device located off to the sidelines of the court. When the game ball hits the said electronic target, the attached indicator shows that the target was really hit and registers the successful scoring point thereof. The paddle or racquet for the game are standard wooden, plastic or strung racquets as used in paddle or racquetball. The posts are secured to a solid floor or designed to be pushed into the grass or sand. The game can be played in or outdoors. The game assembly has opposing basketball style hoops with attached ball nets to a mini-backboard. At least 1 hoop/-net/backboard assembly is located on each side of the vertical scoring net and is positioned so the opposing players can visually see the said assembly and set up the game ball so as to score a point by placing it into the opposing said scoring assembly. The said assembly is positioned higher than the vertical net support means. The supporting posts may be sleeved so as to be lowered or raised for adult to children play.

The game scoring points are achieved in combination:

(1) when the ball goes out of bounds of the playing court;

(2) when the ball hits the playing inbounds surface of the opposing player;

(3) when the ball hits the electronic target sensor and the connecting electric score keeping device registers said contact with said device;

(4) when the ball passes through the said target hole in the said scoring net;

(5) when the ball is placed off the opponents backboard through the hoop into the attached net thereof;

(6) when the ball is played directly into the suspended hoopnet apparatus.

The game has rules and regulations as does any other competitive sport. One novel part of the said game is that each player may catch the ball on his/her racquet and bounce the said ball off their racquet surface so as to set up the said ball for an accurate return shot to his/her opponents scoring assemblies or target area which enables a point scored. In the case of Doubles one partner may set up the other partner for the selected choice of scoring a point, similiar as to beach or indoor volleyball. At NO time can any player touch the said ball with their hands other than on the serve. The game players can not block their opponents shot to the backboard-hoop-net assembly nor go over nor touch the said scoring net assembly.

The balance of the features and advantages of this invention will be apparent during the course of the following drawings and preferred embodiment descriptions.

BRIEF DESCRIPTION OF THE DRAWINGS.

FIG. 2 is a pictorial view of a ball according to an embodiment of the present invention;

FIG. 3 is a front view, of one side, of a ball according to the present invention;

FIG. 4 is a cross sectional view of a ball according to the present invention;

FIG. 5 is a flat/top view of the ball striking wood paddle (on the right) and the ball striking racquet with strings (on the left).

FIG. 7 is a side elevation view illustration of the game apparatus used in playing the game;

FIG. 8 is a side view of the basketball hoop/rim, net and backboard assembly, in combination, of the game apparatus used in playing the game;

DESCRIPTION OF THE PREFERRED EMBODIMENT

Figure 1:
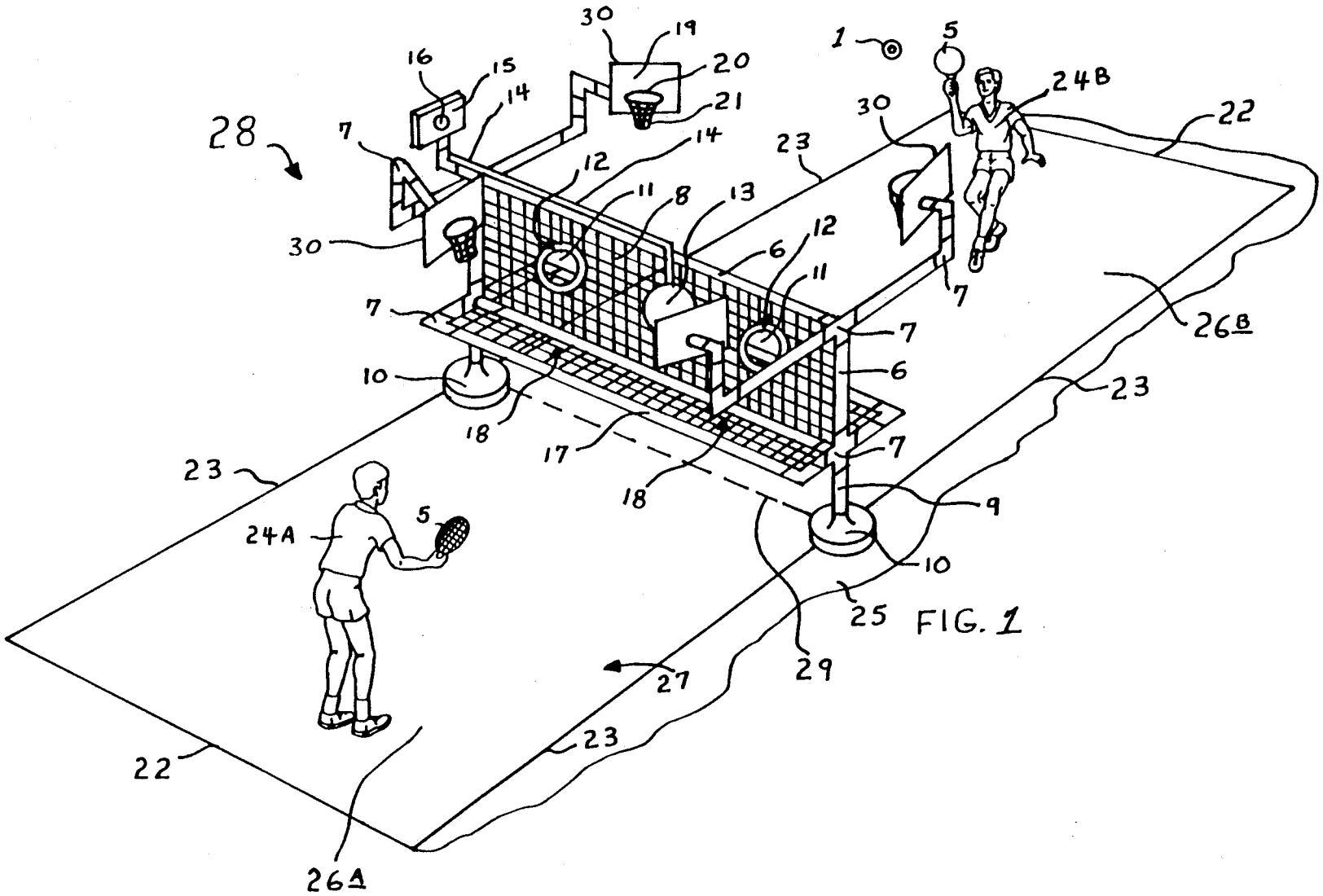
FIG. 1 is a pictorial perpective view illustrating a game of the invention as it is being played by two opposing players on a playing surface within a defined court area.

Referring now to the drawings, and especially to FIG. 1 thereof, a game of the invention is illustrated generally at 28 and is shown being played between two opposed players 24A and 24B on a court 27 of prescibed configuration and measurements. Court 27 extends along a horizontal playing surface 25 and includes first and second opposed playing areas 26A and 26B extending in opposite longitudinal directions from a central court position 29 lying equally between the playing areas 26A and 26B. Each playing area 26A and 26B has a baseline 22 and opposite sidelines 23 extending from the central court position 29 to the corresponding baseline 22. Both sidelines 23 and both baselines 22 are parallel and are considered "out-of-bounds" lines for the court area 27.

In FIG. 1, game 28 is shown being played by two opposed players 24A and 24B each of which player is placed in a corresponding playing area 26A and 26B. Each player 24A and 24B carries a paddle/racquet 5 for striking a game ball 1. One player 24A, designated as the "server", stands behind the service line, also known as the baseline 22 and serves by hitting the ball 1 with the paddle/racquet 5 into the corresponding opposing playing area 26B so as player 24B may volley return the served ball 1. The second player 24B strikes the ball 1 with paddle/racquet 5 and returns the served ball 1 back into the opposing playing area 26A. Either player 24A or 24B may score a point by hitting the electronic target 13 whereby the electric wire 14 carries the successful hit contact back to the score indicating device 15 wherein the indicating light 16 registers the successful hit and point thereof. Both players 24A and 24B may also receive a point by hitting the ball 1 through the target hole 11 in the vertical net 8 which is supported by the P.V.C. pipe vertical net support means 6. The target holes 11 have a border 12 around the outer edge so as to help the players 24A and 24B locate the target holes 11 during the game 28 action. The vertical net support means 6 is interconnected together by corresponding fittings 7. At opposing ends of the vertical support net means 6 is an attached post 9 by fittings 7. Each post has a base 10 which supports the entire assembly 28. The indoor model has a base 10 which allows the entire assembly to rest on a flat surface. In the outdoor model the post 9 is pointed so as to be pushed in the earth or sand. Attached to the posts 9 by interconnecting fittings 7 is the horizontal net support means 17 which catches the ball 1 when either player 24A or 24B misses the target holes 11 or electronic target 13. The ball 1 bounces off the vertical net 8 mesh and lands on the horizontal ball catching net 18 mesh. Players 24A or 24B, having missed the targets 11 or 13, walks up to the horizontal net 18 picks up the ball 1 and returns to the server line 22 and serves again or loses their serve, for a side out.

A further point may be gained by either player 24A or 24B when the ball 1 hits the general court area 27 surface in playing areas 26A or 26B. The "NO BOUNCE" rule applies to the game 28. A point is also received if either player 24A or 24B hits the ball 1 outside the court area 27 beyond either opposing baseline 22 or either opposing sideline 23.

Further points may also be scored by hitting ball 1 off the backboard 19 through hoop/rim 20 into attached net 21. The overall basketball assembly 30 is positioned in opposing backhand and forehand sides within the general court area 27 for both playing areas 26A and 26B. Either opposing player 24A or 24B may score points.

Game 28 is played in a relatively small court which increases the necessity of quick response, touch and accuracy. The ball 1 with holes 2 throughout said ball 1 slow the ball 1 down to stay within a reasonable designated court area 27. Dimensions for a typical court 27, for single 1 on 1, includes ten feet baselines 22 and ten feet sidelines 23. Each playing area 26A and 26B thus is in the form of a square. The base 10 for the indoor model is placed in a center court position 29 on the opposing side lines 23.

The height of the vertical net support means 6 with fittings 7 is is approximately five feet high from the playing surface 25, while the plurality of basketball assemblies 30 are approximately one foot higher than the top of the said vertical net support means 6 with fittings 7.

When doubles is played the game 28 uses the same assembly parts wherein the court playing areas 26A and 26B increase in baseline 22 width to twenty feet while the depth stays the same. The sidelines 23 for doubles would be the same ten feet in length. The number of players 24A and 24B increase to two said players on opposing sides. Each player 24A and 24B have a paddle/racquet 5 while using the ball 1. The number of open target holes 12 will increase along with the number of electronic targets 13 wherein the net mesh 6 and 18 doubles in length for the wider court area 27 as does the frames 6 and 17. The rules and regulations stay the same except that either player 24A or 24B in, singles, may catch the ball 1 on the flat surface of the paddle/racquet 5 and immediately bounce ball 1 into the air to set themselves up for a better shot in order to score a point. In doubles either partner player 24A or 24B may set up each other to gain the advantage of a better position to enable a point scored.

The dimensions and configuration of the court 27 may be varied to adjust for various levels of skill. Thus, it will be seen that game 28 requires only a small space for play. Also, since the ball 1 is not required to bounce from the playing surfaces 26A and 26B, when in play, the surface of the court 25 requires no special preparation or finish and game 28 may be played indoors or outdoors on a wide variety of playing surfaces 25.

Turning now to FIG. 2 the ball 1 of the invention is made with a spherical aerodynamic designed shape. A plurality of holes 2 are cut by punching or drilling into and throughout the ball 1, from one surface to the opposite surface, as shown in more detail in FIG. 4. After several experiments the preferred combination is three identical holes 2 geographically located at equal starting entrance 3 positions while passing entirely through ball 1 to an exit point 4 on the opposite surface. Each hole 2 is preferred round in shape.

The amount of the foam ball 1 material removed may range from 5% to 40% by weight/volume. Preferred is approximately 20% by weight/volume removed from said ball 1. If any less, the ball 1 has less air drag. If any more, the ball 1 will collapse, making the balll unplayable. Twenty percent removed yields a stable playable ball 1 with just enough air drag to limit the distance for playability in the game 28 of the invention.

The ball 1 is manufactured from a polyurethane open cell foam. Preferred is polyether which passes the U.S.A. Federal Safe Toy Act.

The preferred ball 1 diameter is four inches. The right size to handle while fitting through most basketball hoop/rims 20. The pore size of the ball 1 may range from 10 to 100 p.p.i.'S (pores per inch). Preferred is approximately 50 p.p.i.'s. The color of ball 1 may range from a spectrum from white to black.

In FIG. 3 the ball 1 is shown from a front view with hole 2 entrance located in the center.

In FIG. 4 the sectional view of ball reveals a center hole 2 intersected by the cut hole channels entering at 3 and exiting at 4. This view reveals three holes 2 in ball 1.

In FIG. 5 the view is of both a wooden paddle 5 with a handle attached and a racquet 5 with virtical and horizontal interwoven strings attached to a frame with a handle. In both cases the paddle 5 and the racquet 5 are standard ball 1 striking instruments as used in paddleball or racquetball.

Figure 6:
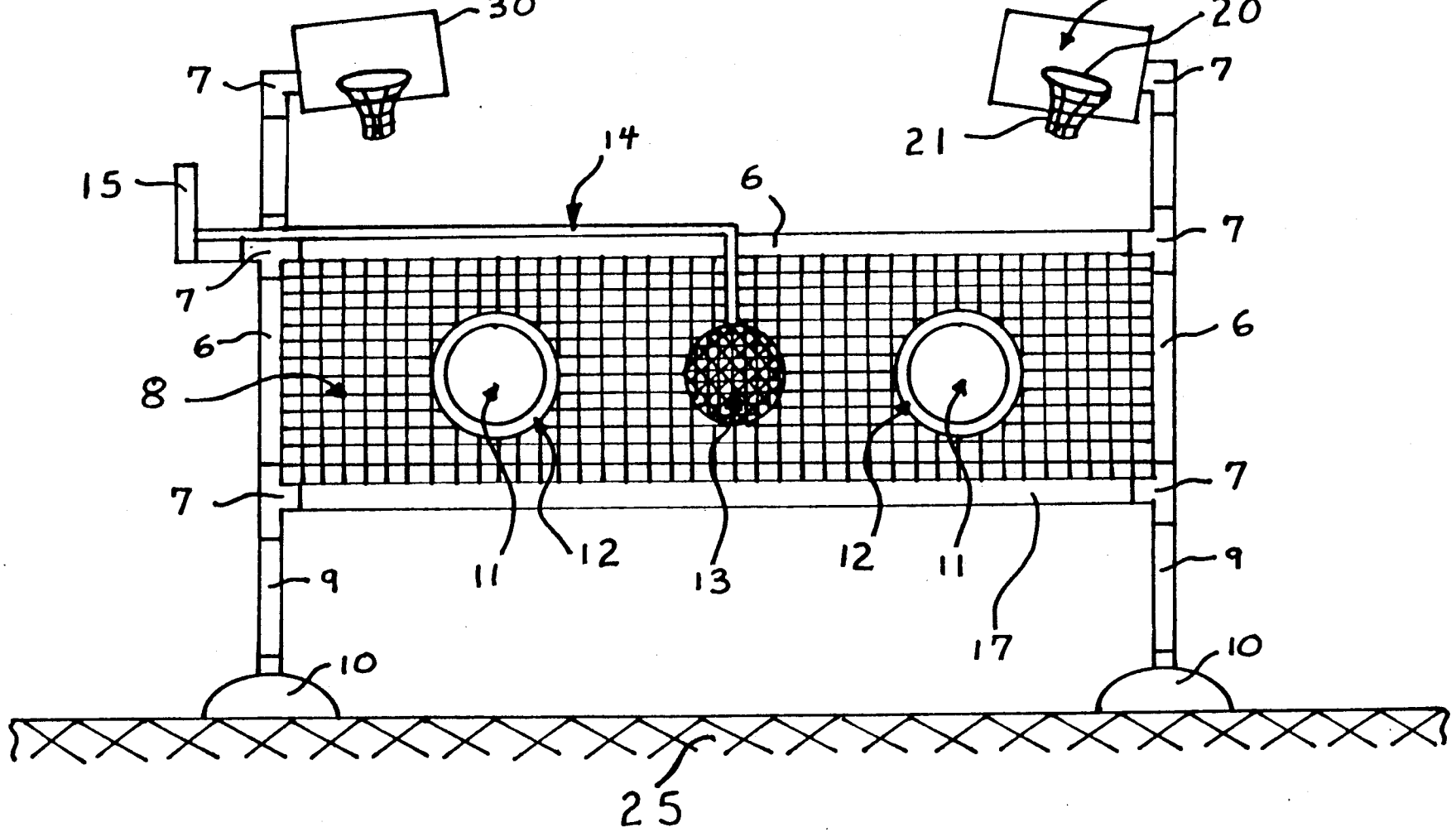
FIG. 6 is a front elevation view illustration of the game apparatus used in playing the game.

Turning now to FIG. 6 a front view of the game 28 of the invention is illustrated with two opposing posts 9 bases 10 on playing surface 25 which support the vertical frame 6 with interconnecting P.V.C. fittings 7 with attached vertical mesh net 8 while attached to mesh net 8 are open hole targets 11 with borders 12 and an electronic target 13 with electric wire 14 running along the top of frame 6 to the attached score indicating device 15. Attached to the top of frame 6 at fittings 7 are the opposing basketball assemblies 30 which include, interconnected thereof, a backboard 19 with attached basketball hoop/rim 20 with attached net 21.

Turning now to FIG. 7 a side elevational view of the game 28 of the invention is illustrating a base 10 on a playing surface 25 with the bottom section of the post 9 supporting the game 28 assembly at fitting 7 with horizontal end section pipe 17 extending in an outward direction being said end section of the ball catching support net means 17 with corner fittings 7 thereof. Extending further up is the end section of the frame for the vertical support net means 6 wherein is attached interconnected opposing basketball assemblies 30. Further attached at the top is an electronic score indicating device 15 with indicating light 16. All sections for the entire frame, with fittings 7, for the game 28 are of P.V.C. tubular pipe.

FIG. 8 shows a side view of the basketball assembly 30 with a backboard 19 with attached hoop/rim 20 and net 21. The entire assembly is interconnected with the aforementioned coordinating P.V.C. pipe and fittings to become part of the overall game 28 of the invention.

Figure 9:
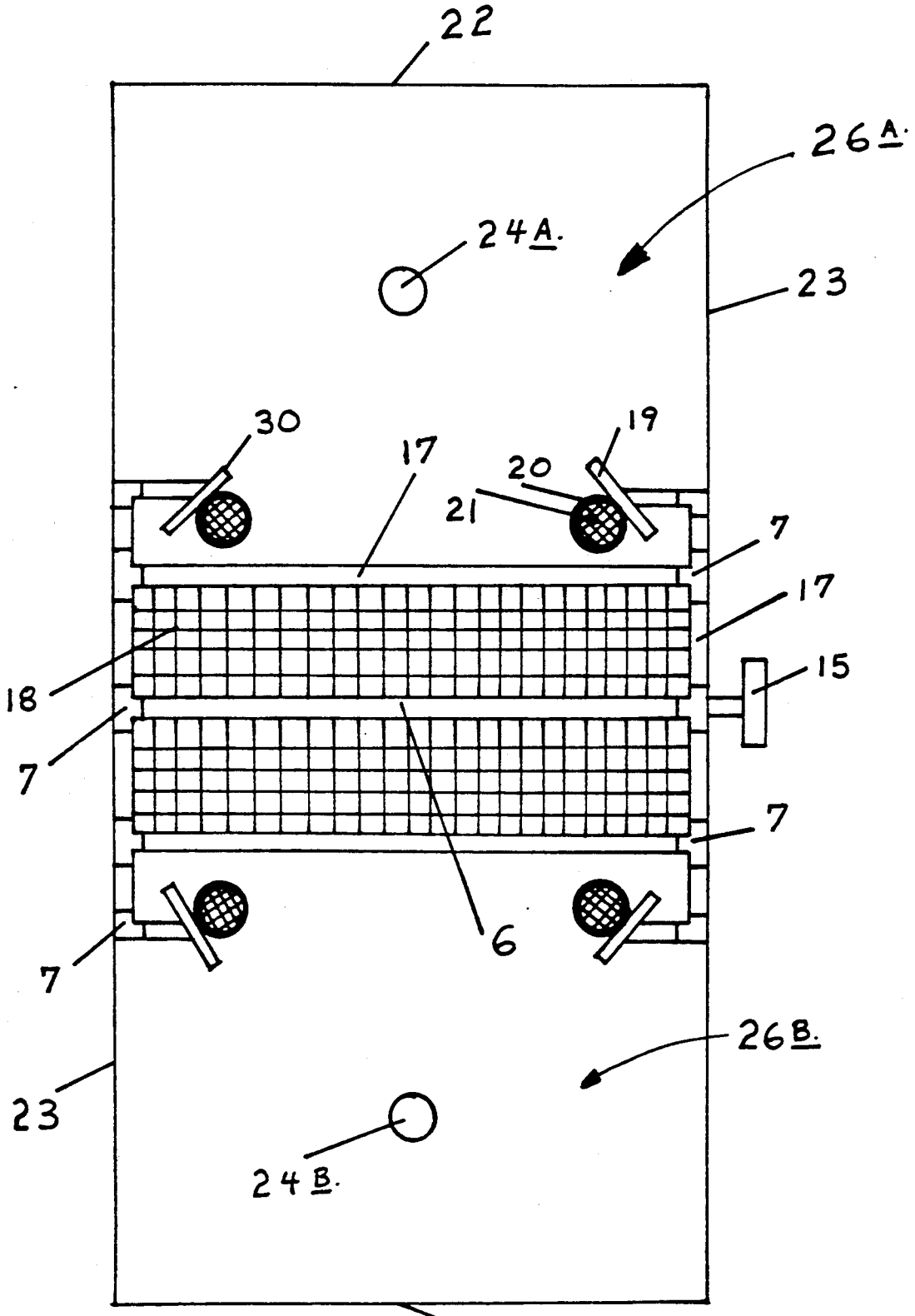
FIG. 9 is a top plan view of the game apparatus used in playing the game.

FIG. 9 is a top plan view of the game 28 of the invention wherein court playing areas 26A and 26B have player 24A and 24B separated by a frame structure 6 and 17 with fittings 7 and net 18 attached in a horizontal position extending into each opposing court playing area 26A and 26B. Each end of the frame structure has opposing basketball assemblies 30 with a backboard 19 with hoop/rim 20 and attached net 21. The entire court area has opposing parallel base lines 22 and opposing parallel side lines 23.

As to the preferred manufactured apparatus of the game 28 of the aforementioned invention with the said ball 1; select the desired foam, shape, diameter size with the number of holes 2 and position of holes 2 and manufacture said game 28 ball 1. For the game 28 apparatus select select the preferred racquet or paddle for singles or doubles play in combination with a frame style, a post style, an open hole target style, a solid electronic target style, a net style, a ball rebound catch net style, a backboard/hoop-rim/net style and construct the game 28 apparatus for in-outdoor use with desired court size along with the game rules and regulations and play the game 28 of the invention.

It is hereby understood that the aforementioned detailed form of the preferred embodiment of the invention is not to be limited to the exact arrangement but is an example only. The arrangement of the parts shown in the drawings or described in the disclosure may be modified without departing from the true spirit and scope of the invention. The details of the shape, size, materials and function of the game of the invention are of novel concept thereof.

Having thus described the invention with an exclusive property or privilage:

What is claimed is:

1. A competitive recreational ball game assembly in which opposed players return a ball within a prescribed court extending along a horizontal playing surface in opposite longitudinal directions from an apparatus located on the playing surface between the players such that the court is divided into first and second opposed playing areas with the apparatus placed therebetween, the ball game assembly comprising in combination:

at least one game ball;

at least one ball striking instrument;

and an apparatus, said apparatus comprising:

a frame having a first horizontal supporting means for supporting a net in a horizontal position, a second vertical supporting means connected to said horizontal supporting means for supporting another net in a vertical position above said horizontal net wherein the horizontal and vertical nets form right angles on either side of said vertical net, a plurality of target holes in said vertical net, each hole dimensioned for said ball, driven by said striking instrument, to pass therethrough, a plurality of supporting stands, each stand connected to and extending downwardly form an opposite lateral edge of said horizontal supporting means for supporting said apparatus on a playing surface, a plurality of third supporting means each connected to said vertical supporting means, each third supporting means supporting a basketball backboard, hoop and net assembly, said hoop and net dimensioned for said ball, driven by said striking instrument, to pass therethrough, each basketball assembly positioned on opposite sides of said vertical net and above said horizontal net.

2. The invention of claim 1 wherein said apparatus comprises an electronic target assembly having two electronic sensors mounted to either side of said vertical net, and an electronic score indicating device connected to said electronic target sensors by means of a wire.

3. The invention of claim 1 wherein said game ball is made of polyurethane foam having open cells.

4. The invention of claim 3 wherein said game ball comprises a plurality of holes formed therethrough wherein the amount of foam material removed to form said holes ranges from 5% 50% of the weight/volume of said original foam material forming said game ball.

5. The invention of claim 4 wherein the holes of said game ball intersect in the center of said ball forming a central cavity in said ball thereby allowing air to pass throughout said ball when struck by the game ball striking instrument.

* * * * *